US007381345B2

(12) United States Patent
Abe et al.

(10) Patent No.: US 7,381,345 B2
(45) Date of Patent: Jun. 3, 2008

(54) FIBER PRODUCT TREATING AGENT

(75) Inventors: Hiroshi Abe, Barcelona (ES); Shoji Saito, Barcelona (ES)

(73) Assignee: Kao Corporation, Tokyo (JP)

( * ) Notice: Subject to any disclaimer, the term of this patent is extended or adjusted under 35 U.S.C. 154(b) by 176 days.

(21) Appl. No.: 11/359,400

(22) Filed: Feb. 23, 2006

(65) Prior Publication Data

US 2006/0198808 A1 Sep. 7, 2006

(30) Foreign Application Priority Data

Mar. 1, 2005 (JP) ..... 2005-055339

(51) Int. Cl.

| | |
|---|---|
| ***D06M 13/325*** | (2006.01) |
| ***D06M 13/00*** | (2006.01) |
| ***D06M 13/328*** | (2006.01) |
| ***D06M 13/402*** | (2006.01) |
| ***D06M 13/46*** | (2006.01) |
| ***D06M 13/463*** | (2006.01) |
| ***C11D 3/50*** | (2006.01) |

(52) U.S. Cl. ..... 252/8.61; 8/115.51; 8/115.6; 252/8.63; 252/8.81; 252/8.91; 427/394; 442/96; 510/513; 510/515; 510/518; 510/521; 510/527; 512/1

(58) Field of Classification Search ..... 252/8.81, 252/8.63, 8.91, 8.61; 510/513, 521, 527, 510/515, 518; 8/115.51, 115.6; 427/394; 442/96; 521/1, 25, 26

See application file for complete search history.

(56) References Cited

U.S. PATENT DOCUMENTS

| | | | | |
|---|---|---|---|---|
| 4,439,330 | A * | 3/1984 | Ooms | 510/524 |
| 5,500,138 | A | 3/1996 | Bacon et al. | |
| 6,787,510 | B2 * | 9/2004 | Santos et al. | 510/101 |

FOREIGN PATENT DOCUMENTS

| | | | |
|---|---|---|---|
| EP | 1 264 874 | A1 | 12/2002 |
| GB | 2313379 | A * | 11/1997 |
| JP | 62-110977 | | 5/1987 |
| JP | 8113871 | A * | 5/1996 |
| JP | 11-81134 | | 3/1999 |
| JP | 2004-99743 | | 4/2004 |
| JP | 2004-143638 | | 5/2004 |
| WO | WO 97/31086 | | 8/1997 |
| WO | WO 02/074729 | A2 | 9/2002 |
| WO | WO 02/074729 | A3 | 9/2002 |
| WO | WO 2004/014332 | A1 | 2/2004 |

* cited by examiner

*Primary Examiner*—Anthony J Green
(74) *Attorney, Agent, or Firm*—Oblon, Spivak, McClelland, Maier & Neustadt, P.C.

(57) ABSTRACT

The present invention relates to a fiber product treating agent and a method of increasing the longevity of perfume in a fiber product treating agent. The present invention specifically relates to a fiber product treating agent containing (a) a compounds represented by the following formulae (1-1) and (1-2) and (b) a perfume, wherein the content of compounds as component (a) in which the carbon number of $R^{11}$ is 21 or more is 50% by weight or more, or a fiber product treating agent comprising the above components (a) and (b), wherein the content of perfumery components having a boiling point of 250° C. or more and a logPow of 3 or more is 20% by weight or more in the component (b), and a method of using the above component (a) to increase the longevity of the perfume in the fiber product treating agent.

(1-1)

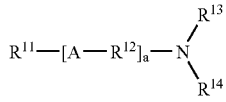

(1-2)

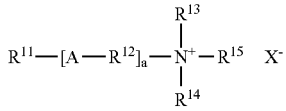

wherein $R^{11}$ represents a $C_{15-23}$ alkyl or alkenyl group, A represents —CONH— or —NHCO—, $R1^{12}$ represents a $C_{1-6}$ alkylene group, $R^{13}$ and $R^{14}$ respectively represent a $C_{1-3}$ alkyl or hydroxyalkyl group, $R^{15}$ represents H or $C_{1-3}$ alkyl or hydroxyalkyl group, a denotes a number of 0 or 1 and $X^-$represents an anionic group.

8 Claims, No Drawings

FIBER PRODUCT TREATING AGENT

FIELD OF THE INVENTION

The present invention relates to a fiber product treating agent and to a method of providing an improved longevity of perfume of a fiber product treating agent.

BACKGROUND OF THE INVENTION

It is demanded of fiber product treating agents to impart, as fundamental performances, softness, fluffy feel and tenseness to fibers corresponding to their uses. On the other hand, products that satisfy the emotional sense of users by means of, for example, fragrances are attractive to the users. Specific examples of these products include fiber product treating agents that retain a fragrance of a perfume not only during washing and drying but also when a fiber product is worn (a fiber product have longevity of perfume). As to such technologies, some methods have been already proposed. For example, a composition in which a specific perfume and retainer are blended in a combination of, for example, a tertiary amine having a specific structure and a fatty acid (JP-A11-81134) and a composition in which a specific antibacterial agent such as benzaldehyde and a specific perfume are combined (JP-A2004-143638) are known. In the meantime, technologies are disclosed in which a perfume is not merely blended simply but also made possible to prepare a composition which is used in various applications and has excellent retaining ability after it is micro-capsulated using a polymer material (JP-A2004-99743).

SUMMARY OF THE INVENTION

The present invention relates to a fiber product treating agent containing (a) at least one compound selected from the compounds represented by the following formulae (1-1) and (1-2) and (b) a perfume, wherein the content of compounds as component (a) in which the carbon number of $R^{11}$ is 21 or more is 50% by weight or more.

(1-1)

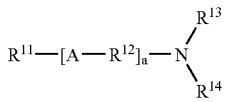

(1-2)

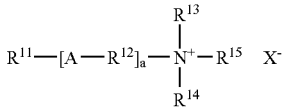

In the formula, $R^{11}$ represents an alkyl or alkenyl group having 15 to 23 carbon atoms, A represents —CONH— or —NHCO—, $R^{12}$represents an alkylene group having 1 to 6 carbon atoms, $R^{13}$ and $R^{14}$ respectively represent a hydrogen atom or an alkyl or hydroxyalkyl group having 1 to 3 carbon atoms, $R^{15}$ represents a hydrogen atom or an alkyl or hydroxyalkyl group having 1 to 3 carbon atoms, a denotes a number of 0 or 1 and $X^-$0 represents an anionic group.

Also, the present invention relates to a fiber product treating agent containing (a) at least one compound selected from the compounds represented by the above formulae (1-1) and (1-2) and (b) a perfume, wherein the content of perfumery components having a boiling point of 250° C. or more and a logPow of 3 or more is 20% by weight or more in the component (b).

Also, the present invention relates to use of the composition containing components (a) and (b) as a fiber product treating agent.

Further, the present invention relates to a method of using at least one compound selected from the compounds represented by the above formulae (1-1) and (1-2) to provide the fiber product treating agent with an improved longevity of perfume. Also, the present invention relates to a method of treating a fiber product by the above components (a) and (b).

DETAILED DESCRIPTION OF THE INVENTION

In the methods described in the above prior technologies, there is a fear that the original functions (softness and fluffy feel) of fiber product treating agents are impaired. Also, in the case of forming the microcapsule, its production step is complicated and these methods are therefore considered to be undesirable from the viewpoint of costs.

The present invention relates to a fiber product treating agent that can outstandingly improve the longevity of perfume of the treated fiber product without impairing the original performance of the fiber product treating agent and to a method of increasing the longevity of perfume in a fiber product treating agent.

According to the fiber product treating agent of the present invention, the retaining ability of a perfume in the fiber product treating agent can be greatly improved while the softening ability of the agent is improved.

The present invention relates to the fiber product treating agent further containing at least one compound (hereinafter referred to as a component (c)) selected from compounds represented by the following formulae (2-1) to (2-3).

(2-1)

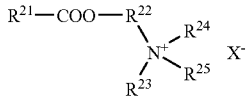

(2-2)

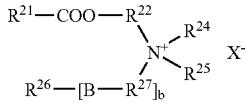

(2-3)

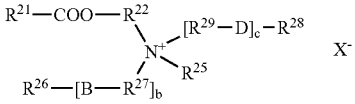

In the formulae, $R^{21}$, $R^{26}$ and $R^{28}$ respectively represent an alkyl or alkenyl group having 15 to 20 carbon atoms, $R^{22}$, $R^{27}$ and $R^{29}$ respectively represent an alkylene group having 1 to 6 carbon atoms, $R^{23}$ and $R^{24}$ respectively represent an alkyl or hydroxyalkyl group having 1 to 3 carbon atoms, $R^{25}$ represents a hydrogen atom or an alkyl or hydroxyalkyl group having 1 to 3 carbon atoms, B and D respectively represent a group selected from —COO—, —OCO—, —CONH— and —NHCO—, b and c respectively denote a number of 0 or 1 and $X^-$ represents an anionic group.

[Component (a)]

The component (a) is at least one compound selected from the compounds represented by the above formulae (1-1) and (1-2).

In the formulae (1-1) and (1-2), $R^{11}$ is preferably an alkyl group having 15 to 23 carbon atoms. Though an alkenyl group having 15 to 23 carbon atoms may be contained as $R^{11}$, the content of the alkenyl group is preferably 50 mol % or less, more preferably 25 mol % or less and even more preferably 5 mol % or less based on the whole of $R^{11}$. A is preferably —CONH—, $R^{12}$ is preferably an alkylene group having 3 carbon atoms and a is preferably 1. $R^{13}$ and $R^{14}$ are respectively preferably a methyl group or an ethyl group. $R^{15}$is preferably a hydrogen atom, a methyl group or an ethyl group. Examples of $X^-$ include halogen ions and inorganic acid or organic acid ions such as sulfuric acid ions, alkyl (number of carbons: 1 to 3) sulfuric acid ions and fatty acid ions having 1 to 12 carbon atoms. Among these ions, halogen ions and alkyl (1 to 3 carbon atoms) sulfuric acid ions are preferable.

A compound represented by the formula (1-1) in which A is —CONH— can be obtained by an amidation reaction between a corresponding dialkylaminoalkylamine (preferably N,N-dimethyl-1,3-propanediamine) and a fatty acid represented by the formula $R^{11}$—$COOR^{16}$ ($R^{16}$ is a hydrogen atom or an alkyl group having 1 to 3 carbon atoms) or a lower alkyl ester thereof.

A compound represented by the formula (1-2) in which A is —CONH— and $R^{15}$ is a hydrogen atom can be obtained as follows: after an amidation reaction as described above, the obtained compound is neutralized by an inorganic acid selected from hydrochloric acid, sulfuric acid and phosphoric acid or an organic acid selected from citric acid, malic acid, lactic acid, succinic acid, glycolic acid, fatty acid having 1 to 12 carbon atoms and benzenesulfonic acid which may be substituted with 1 to 3 alkyl groups having 1 to 3 carbon atoms. Also, a compound represented by the formula (1-2) in which $R^{15}$ is an alkyl group having 1 to 3 carbon atoms can be obtained by carrying out alkylation using an alkylating agent such as dialkylsulfuric acid or alkyl halide. Further, a compound represented by the formula (1-2) in which $R^{15}$ is a hydroxyalkyl group can be obtained as follows: after neutralized by the above inorganic acid or organic acid, the neutralized product is hydroxyalkylated by ethylene oxide or propylene oxide.

Among the component (a), those in which the content of compounds represented by the formula (1-1) or (1-2) in which $R^{11}$ has 21 or more carbon atoms is 50% by weight or more, more preferably 60% by weight or more, even more preferably 70% by weight, even more preferably 80% or more are particularly preferable.

[Component (b)]

As the perfume which is the component (b) of the present invention, perfumes containing perfumery components (hereinafter referred to as a perfumery component (b1)) having a logPow of 2.0 or more, preferably 2.0 or more and 7.0 or less and more preferably 3.0 or more and 7.0 or less in an amount of 20% by weight or more are preferable. The content of the perfumery component (b1) in the component (b) is preferably 50% by weight or more, more preferably 70% by weight or more, even more preferably 80% by weight or more and even more preferably 90% by weight or more.

On the other hand, it is more preferable to contain a perfumery component having a higher logPow, that is, a more hydrophobic perfumery component. A perfumery component having a logPow of 3.0 or more is contained in the component (b) in an amount of preferably 20% by weight or more, more preferably 30% by weight or more and even more preferably 40% by weight or more. Also, the boiling point of this perfumery component is preferably 250° C. or more.

Here, the above logPow means the 1-octanol/water distribution coefficient of a chemical substance and a value calculated by the f-value method (hydrophobic fragment constant method). Specifically, the chemical structure of a compound is broken down into its structural elements and the hydrophobic fragment constant (f-value) of each fragment is added up to find the logPow of the compound. In this case, CLOGP3 Reference Manual Daylight Software 4.34, AlbertLeo, David Weininger, Version 1, March 1994 may be used as a reference.

Examples of the component (b) include the following compounds.

Ambrettolide, 3α,6,6,9α-tetramethyldodecahydronaphtho[2,1-b]furan (trade name: Ambroxane), dodecahydro-3α,6,6,9α-tetramethyl-naphtho[2,1-b]furan (trade name: Ambrox DL), amylcinnamicaldehyde, auranthiolbenzophenone, benzyl benzoate, benzyl salicylate, ethoxymethyl cyclododecyl ether (trade name: Bowie Sambrene Forte), cinnamyl cinnamate, cyclamen aldehyde, cyclohexyl salicylate, ethyl-2-t-butylcyclohexyl carbonate (trade name: Floramat), ethyltricyclo[5.2.1.02,6]decane-2-yl carboxylate (trade name: Fultate), geranyl acetate, hexylcinnamic aldehyde, hexyl salicylate, α-ionone, β-ionone, iso.e.super, isoamyl salicylate, isobutyquinoline, methylcyclooctyl carbonate (trade name: Jasmashicrat), methylenetetramethylheptanone (trade name: Coabon), δ-decalactone, γ-decalactone, lilial, muscone, β-naphthol ethyl ether (trade name: Nerobromeria), β-naphthol methyl ether (trade name: Nelorine Yarayara), galaxolide (trade name: Pearlride), phenylethyl phenylacetate, p-t-butylcyclohexyl acetate, 2-methyl-4-(2,2,3-trimethyl-3-cyclopentene-1-yl)-2-butene-1-ol (sandal mysolcoa), 4-methyl-3-decene-5-ol (Undeca-Vertol) and vetiveryl acetate.

The component (b) of the present invention is a perfume containing the above compound in an amount of preferably 30% by weight or more, more preferably 50% by weight or more, even more preferably 70% by weight or more, even more preferably 80% by weight or more and even more preferably 90% by weight or more. Particularly, the component (a) according to the present invention is effective from the viewpoint of exhibiting the longevity of perfume selected from lilial, iso.e.super, hexylcinnamic aldehyde and Ambroxane.

The component (b) used in the present invention may contain a perfumery component having a logPow of −0.5 or more and less than 2.0, a diluent and a retainer besides the above perfumery components. Preferable examples of a perfumery component having a logPow of −0.5 or more and less than 2.0 may include phenylethyl alcohol, cis-3-hexenol, helional, benzaldehyde, dimethylbenzylcarbinyl acetate, maltol, cumarin, anisaldehyde, and the like. Also, preferable examples of the diluent and retainer may include dipropylene glycol, isopropyl palmitate ester, diethylphthalate, penzyl benzoate, liquid paraffin, isoparaffin, oil and fats, and the like. The ratio by weight of the perfumery component to the retainer is preferably 1/0 to 2/8.

[Component (c)]

The component (c) used in the present invention is at least one compound selected from compounds represented by the above formulae (2-1) to (2-3).

In the formulae (2-1) to (2-3), $R^{21}$, $R^{26}$ and $R^{28}$ are respectively preferably an alkyl or alkenyl group having 15 to 17 carbon atoms. Although the ratio of the alkenyl group to the total mols of $R^{21}$, $R^{26}$ and $R^{28}$ (number of mols in the case where only $R^{21}$ is contained, $R^{21}$ and $R^{26}$ are both contained or $R^{21}$, $R^{26}$ and $R^{26}$ are all contained) maybe optional, a composition containing the alkenyl group in a relatively larger amount, a composition containing the alkyl group in a moderate amount or a composition containing almost none of the alkenyl group is preferable from the viewpoint of blending stability. Specifically, the composition containing the alkenyl group in a relatively large amount preferably contains the alkenyl group in an amount of 80 to 100 mol %, preferably 85 to 99 mol %, more preferably 87 to 99 mol %, even more preferably 90 to 99 mol % and even more preferably 95 to 99 mol %. Also, the alkenyl group having two or more carbon-carbon unsaturated bonds tends to promote the generation of an offensive odor, it is contained in an amount of preferably 10 mol % or less, more preferably 8 mol % or less, even more preferably 5 mol % or less and even more preferably 3 mol % or less based on the total mol numbers of $R^{21}$, $R^{26}$ and $R^{28}$ (has the same meaning as above). Also, the composition having the alkyl group in a moderate amount is a preferable composition also in a sense of simplification of availability of the raw material source. Specifically, the composition has the alkenyl group in an amount of preferably 40 to 70 mol %, more preferably 45 to 70 mol % and even more preferably 50 to 65 mol %. On the other hand, in the composition having almost none of the alkenyl group, the amount of the alkenyl group is preferably 0 to 8 mol %, more preferably 0 to 5 mol % and even more preferably 0 to 3 mol %.

In the formulae (2-1) to (2-3), $R^{23}$ is preferably a hydroxyethyl group. $R^{24}$ is preferably a methyl group or a hydroxyethyl group. $R^{25}$ is preferably a methyl group or an ethyl group. $R^{27}$ and $R^{29}$ are respectively preferably an ethylene group. B and Dare respectively preferably —COO—, and b and c is respectively preferably 1. $X^-$ is preferably the same group as in the case of the above component (a).

A compound represented by the formula (2-1) and a compound represented by the formulae (2-2) or (2-3) in which B and D are respectively —COO— may be produced, for example, in the following manner: an amine produced by a dehydration esterification reaction between a fatty acid having the above preferable alkyl and alkenyl composition and a corresponding monoalkyldialkanolamine (preferably methyldiethanolamine) or a trialkanolamine (preferably triethanolamine), or by an esterification between a fatty acid lower alkyl (1 to 3 carbon atoms) ester having the preferable alkyl composition and a corresponding monoalkyldialkanolamine (preferably methyldiethanolamine) or trialkanolamine (preferably triethanolamine) is made to enter into a quaternary reaction using an alkylating agent such as dialkylsulfuric acid (1 to 3 carbon atoms) or an alkyl halide (1 to 3 carbon atoms).

The fatty acid or the fatty acid lower alkyl ester is preferably those having a fatty acid composition obtained by saponifying oil and fats selected from beef tallow, palm oil, sunflower oil, soybean oil, safflower oil, cotton seed oil, corn oil and olive oil. Particularly, those having a fatty acid composition obtained by saponifying beef tallow, palm oil or sunflower oil are desirable from the point of transparency and the effect of deodorizing external environmental odors.

Also, these fatty acids have alkenyl groups containing two or more carbon-carbon unsaturated bonds in a large amount and are therefore purified by crystallization as described in, for example, JP-A4-306296, by a method in which a methyl ester is distilled under reduced pressure as described in JP-A6-41578 or a method in which the proportion of fatty acids having two or more carbon-carbon unsaturated bonds is controlled by carrying out a selective hydrogenating reaction as described in JP-A8-99036.

In the case of beef tallow fatty acid or fatty acid derived from a selective hydrogenating reaction, a mixture of geometrical isomers in view of unsaturated bonds is contained. In the present invention, those containing the mixtures in which the ratio of cis isomers/trans isomers (molar ratio) is preferably 25/75 to 100/0 and more preferably 50/50 to 95/5 are used.

The ratio (molar ratio) of the fatty acid or fatty acid lower alkyl ester to the monomethyldialkanolamine or trialkanolamine in the esterification reaction or ester exchange reaction is preferably 1.4:1 to 2.2:1 and more preferably 1.6:1 to 2.0:1.

When an esterification reaction or an ester exchange reaction is carried out between the trialkanolamine and the fatty acid or fatty acid lower alkyl ester and in succession, a quaternary reaction is carried out, a mixture of a compound represented by the formula (2-1) in which $R^{23}$ and $R^{24}$ are respectively a hydroxyalkyl group, a compound represented by the formula (2-2) in which $R^{24}$ is a hydroxyalkyl group and a compound represented by the formula (2-3) is obtained.

In the present invention, the component (c) is preferably a mixture of a compound represented by the formula (2-1) and contained in an amount of preferably 10 to 30% by weight, more preferably 12 to 28% by weight and even more preferably 15 to 25% by weight, a compound represented by the formula (2-2) and contained in an amount of preferably 35 to 50% by weight, more preferably 40 to 50% by weight and even more preferably 42 to 48% by weight and a compound represented by the formula (2-3) and contained in an amount of preferably 20 to 50% by weight, more preferably 20 to 45% by weight and even more preferably 25 to 40% by weight from the viewpoint of softening effect, preserving stability and the effect of deodorizing external environmental odors.

[Other Components]

The fiber product treating agent of the present invention preferably contains an anionic surfactant (hereinafter referred to as a component (d)) with the intention of more improving the softening effect though this is optional. The component (d) is preferably an anionic surfactant (hereinafter referred to as a component (d2)) containing a saturated or unsaturated fatty acid having 14 to 20 carbon atoms and preferably 16 to 18 carbon atoms or its alkali metal or alkali earth metal salt (hereinafter referred to as a component (d1)), or an alkyl group or alkenyl group having 16 to 36 and preferably 16 to 28 carbon atoms, and a —$SO_3M$ group and/or —$OSO_3M$ group (M: counter ion)

Examples of the component (d1) may include fatty acids selected from myristic acid, palmitic acid, stearic acid, oleic acid and palmitoleic acid or salts of these acids. Among these compounds, particularly stearic acid and oleic acid are preferable.

The component (d2) is preferably an alkylbenzenesulfonic acid, alkyl (or alkenyl) sulfate, polyoxyalkylene alkyl(or alkenyl) ether sulfate, olefinsulfonic acid, alkanesulfonic acid, α-sulfo-fatty acid, α-sulfo-fatty acid ester having the above number of carbon atoms or salts of these compounds. It is preferable to formulate one or more compounds selected from alkyl (or alkenyl) sulfates having an alkyl or alkenyl group having 16 to 28 carbon atoms, polyoxyethylene alkyl (or alkenyl) ether sulfates having an alkyl or alkenyl group having 16 to 28 carbon atoms and an ethylene oxide average addition mol number of 1 to 6, preferably 1 to 4 and more preferably 1 to 3 and salts of these compounds. As the salt, a sodium salt, potassium salt and magnesium salt is preferable from the viewpoint of preserving stability.

The fiber product treating agent preferably contains a sequestering agent as a component (e). The sequestering agent is preferably one or more compounds selected from (I) polycarboxylic acid compounds such as citric acid, malic acid and succinic acid, (II) aminopolycarboxylic acids such as ethylenediaminetetraacetic acid, diethylenetriaminepentaacetic acid and hydroxyethyliminodiacetic acid and (III) phosphonic acids such as 1-hydroxyethylidene-1,1-diphosphonic acid and ethylenediaminetetramethylphosphonic acid. As the component (e), particularly ethylenediaminetetraacetic acid and/or 1-hydroxyethylidene-1,1-diphosphonic acid is preferable.

The fiber product treating agent of the present invention may contain an inorganic salt as a component (f) The inorganic salt is preferably a sodium sulfate, sodium chloride, calcium chloride or magnesium chloride from the viewpoint of preserving stability. In this case, though sodium salts and potassium salts are contained in surfactants such as fatty acid salts, the above limitation is not put on inorganic salts intermingled in the composition by the use of such a surfactant.

The fiber product treating agent of the present invention may contain, as a component (g), an ester compound obtained from a saturated or unsaturated fatty acid having 8 to 22 carbon atoms and a polyhydric alcohol. In this case, it is preferred to pay notice to the kind and content of the ester compound to obtain transparent appearance. Examples of the ester compound, which may be contained, may include triglycerides, diglycerides, monoglycerides, mono-, di- or tri-esters of pentaerythritol and sorbitan esters.

The fiber product treating agent of the present invention may contain an organic solvent (hereinafter referred to as a component (h)). Specifically, the organic solvent is a solvent selected from ethanol, isopropanol, glycerin, ethylene glycol and propylene glycol and preferably ethanol from the point of an odor.

[Fiber Product Treating Agent]

The fiber product treating agent of the present invention preferably has a structure in which the above components (a) and (b), and, as the need arise, the above component (c) and other components are dissolved or dispersed in water.

In the fiber product treating agent of the present invention, the content of the component (a) is preferably 0.01 to 10.0% by weight, more preferably 0.03 to 8.0% by weight and even more preferably 0.05 to 5.0% by weight. The content of the component (b) is preferably 0.01 to 5.0% by weight and more preferably 0.1 to 3.0% by weight. The ratio (a)/(b) (weight ratio) of the component (a) to the component (b) is preferably 1/50 to 1000/1, more preferably 1/30 to 500/1 and even more preferably 1/10 to 100/1.

The fiber product treating agent of the present invention preferably contains the component (c). The content of the component (c) is preferably 3 to 30% by weight, more preferably 4 to 28% by weight and even more preferably 5 to 25% by weight. When the component (c) is compounded, the ratio (a)/(c) (weight ratio) of the component (a) to the component (c) is preferably 1/3000 to 10/3, more preferably 1/2000 to 10/5 and even more preferably 1/1000 to 1/1.

In the present invention, at least one compound selected from the compounds represented by the above formulae (1-1) and (1-2) is blended in the fiber product treating agent, thereby making it possible to increase the longevity of perfume of a fiber product treating agent.

EXAMPLES

The following examples are examples of the present invention. These examples are described as to examples of the present invention and are not intended to be limiting of the present invention.

In the following examples, "%" means % by weight, unless otherwise specified. Also, in the following examples, perfumes A to D shown in Table 1 were used as the perfume.

TABLE 1

| | | Perfume | | | |
|---|---|---|---|---|---|
| | | A | B | C | D |
| Composition of the perfume (mass-%) | Methyl di-hydrojasmonate | 20.0 | 20.0 | 20.0 | 10.0 |
| | Tetrahydrolinalol | 20.0 | 15.0 | 10.0 | 10.0 |
| | Aldehyde C-14 peach*1 | 0.5 | 0.5 | 0.5 | 0.5 |
| | Lillial*1 | 0.5 | 1.0 | 4.0 | 10.0 |
| | Methyl ionone-gamma | 15.0 | 15.0 | 15.0 | 15.0 |
| | Orthotertiary butylcyclohexyl acetate | 15.0 | 15.0 | 15.0 | 15.0 |
| | Limonene | 20.0 | 15.0 | 10.0 | 10.0 |
| | Cyclohexyl salicylate*1 | 5.0 | 10.0 | 10.0 | 14.0 |
| | Iso-e-super*1 | 3.0 | 4.0 | 5.0 | 5.0 |
| | Hexylcinnamic aldehyde*1 | 0.5 | 4.0 | 10.0 | 10.0 |
| | Ambroxane*1 | 0.5 | 0.5 | 0.5 | 0.5 |
| | Total | 100.0 | 100.0 | 100.0 | 100.0 |
| The ratio of perfumery components having a boiling point of 250° C. or more and a logPow of 3 or more (wt %). | | 10.0 | 20.0 | 30.0 | 40.0 |

*1These perfumes are the perfumes having a boiling point of 250° C. or more and logPow of 3 or more.

Synthetic Example 1

A four-neck flask equipped with a stirrer, a temperature gage and a dehydrating tube was charged with 166.1 g of N,N-dimethyl-1,3-propanediamine, 306.7 g of behenic acid and 52.1 g of stearic acid and the mixture was heated to 180° C. Next, the mixture was stirred at that temperature under heating for about 5 hours with distilling the water produced. Then, the reaction solution was cooled to 120° C. and unreacted amine was distilled under reduced pressure to obtain the target N-[3-(dimethylamino)propyl]alkaneamide (hereinafter referred to as a compound (a-1)). In this compound (a-1), the proportion of a compound represented by the formula (i-1) in which $R^{11}$ is an alkyl group having 21 carbon atoms was 85%.

Synthetic Example 2

The same procedures as in Synthetic Example 1 were conducted using 172.2 g of N,N-dimethyl-1,3-propanediamine, 223.7 g of behenic acid and 131.7 g of stearic acid to obtain the target N-[3-(dimethylamino)propyl]alkane or alkeneamide (hereinafter referred to as a compound (a-2)) In this compound (a-2), the proportion of a compound represented by the formula (1-1) in which $R^{11}$ is an alkyl group having 21 carbon atoms was 62%.

Synthetic Example 3

100 g of the compound (a-1) produced in Synthetic Example 1 and 300 g of ethanol were charged into an autoclave and then the atmosphere in the autoclave was replaced with nitrogen. Next, 14.6 g of methyl chloride was introduced into the autoclave under pressure to heat the mixture up to 80° C. with stirring and the mixture was ripened for 3 hours. After the reaction mixture was cooled, it was taken out of the autoclave and ethanol was removed from the reaction mixture to obtain the target N-alkanoylaminopropyl-N,N,N-trimethylammonium chloride (hereinafter referred to as a compound (a-3)).

Synthetic Example 4

100 g of the compound (a-1) produced in Synthetic Example 1 and 600 g of ethanol were charged into a four-neck flask equipped with a stirrer, a temperature gage and a dehydrating tube and then the atmosphere in the flask was replaced with nitrogen. Next, the mixture was raised up to 60° C. with stirring and 28.9 g of dimethylsulfuric acid was added dropwise to the mixture from a dropping funnel over 3 hours, followed by ripening the reaction mixture for further 3 hours. After the ripening operation was completed, ethanol was removed from the reaction mixture to obtain the target N-alkanoylaminopropyl-N,N,N-trimethylammoniummethyl sulfate (hereinafter referred to as a compound (a-4)).

Synthetic Example 5

The same procedures as in Synthetic Example 1 were conducted using 191.7 g of N,N-dimethyl-1,3-propanediamine, 243.1 g of stearic acid and 101.6 g of palmitic acid to obtain the target N-[3-(dimethylamino)propyl]alkaneamide (hereinafter referred to as a compound (a-5)).

Synthetic Example 6

A fatty acid that was produced using sunflower oil as a raw material and had a iodine value of 90 $gI_2$/100 g and an acid value of 201 mg KOH/g and triethanolamine were used. These compounds were mixed in a reaction molar ratio of 1.95/1 (fatty acid/triethanolamine) and subjected to a dehydration condensation reaction carried out according to the usual method. Next, the obtained condensate was converted into a quaternary compound by using 0.95 equivalents of dimethylsulfuric acid in the presence of an ethanol solvent according to the usual method. Thus, a mixture of quaternary ammonium salts (hereinafter referred to as a compound (c-1)) was obtained which included 13% of N-oleoyloxyethyl-N,N-dihydroxyethyl-N-methylammoniummethyl sulfate, 37% of N,N-dioleoyloxyethyl-N-hydroxyethyl-N-methylammoniummethyl sulfate, 31% of N,N,N-trioleoyloxyethyl-N-methylammoniummethyl sulfate and 10% of ethanol. The remainder components were the dehydration condensate (amine) that did not proceed with the reaction forming quaternary compounds, its acid salt and the fatty acid.

Synthetic Example 7

A fatty acid containing stearic acid and palmitic acid mixed in a ratio by weight of 7/3 was used in place of the fatty acid produced using a sunflower oil as a raw material in Synthetic example 6 to carry out a dehydration condensation reaction at the molar ratio of 1.95:1 (fatty acid/triethanolamine) according to the usual method. Next, the obtained condensate was converted into a quaternary compound according to the usual method. Thus, a mixture of quaternary ammonium salts (hereinafter referred to as a compound (c-2)) was obtained which included 13% of N-alkanoyloxyethyl-N,N-dihydroxyethyl-N-methylammoniummethyl sulfate, 37% of N,N-dialkanoyloxyethyl-N-hydroxyethyl-N-methylammoniummethyl sulfate, 31% of N,N,N-trialkanoyloxyethyl-N-methylammoniummethyl sulfate and 10% of ethanol. The remainder components were the dehydration condensate (amine) that did not proceed with the reaction forming quaternary compounds, its acid salt and the fatty acid.

Example 1

Each fiber product treating agent having the composition shown in Table 2 was used to carry out softening treatment using the following method and its longevity of perfume and softness were evaluated according to the following methods. The results are shown in Table 2.

<Method of Softening Treatment>

Five bath towels (cotton 100%) were washed with a commercially available weak alkaline detergent (product name: Attack, manufactured by Kao Corporation) in a washing machine (Two-tank type washing machine VH-360S1, manufactured by Toshiba Corporation, detergent concentration: 0.0667% by weight, using 30 L of city water, water temperature: 20° C., 10 minutes). Thereafter, the washing solution was discharged and the towels were dewatered. Then, 30 L of city water was poured into the washing machine to rinse for five minutes, the washing water was discharged and the towels were dewatered for 3 minutes. Then, 30 L of city water was again poured into the washing machine and then 7 ml of the fiber product treating agent of Table 2 was added, followed by stirring for 5 minutes and then the towels were dewatered.

<Method of Evaluation of the Longevity of Perfume>

With regards to the bath towels that had been subjected to the above softening treatment, 6 panelists actually smelled at each towel to evaluate longevity of perfume according to the following standard, thereby rating each treating agent by an average score (wet score) of the above 6 panelists. Then, the towels were dried at normal temperature and evaluated, after one day or three days, in view of the longevity of perfume in the same manner as above. Results are called as after drying, one day later and after drying, 3 days later, respectively.

·Evaluation Standard of Longevity of Perfume

The scent of the fiber product treating agent itself was rated as 10 points and no scent was rated as 0 point to rate in steps of 0.5 points.

<Method of Evaluation of Softness>

The bath towels that had been subjected to the above softening treatment were air-dried in a place getting a lot of sunlight and then the softness of each towel was functionally evaluated by 6 panelists according to the following standard.

Evaluation Standard of Softness

○: Superior to products to which the fiber product treating agent is not added.

Δ: The same as products to which the fiber product treating agent is not added.

×: Inferior to products to which the fiber product treating agent is not added.

TABLE 2

| | | Product of the invention | | | | | Comparative product |
|---|---|---|---|---|---|---|---|
| | | 1 | 2 | 3 | 4 | 5 | 1 |
| Fiber product treating agent (wt %) | (a-1) | 0.4 | | | | 0.4 | |
| | (a-2) | | 0.4 | | | | |
| | (a-3) | | | 0.4 | | | |
| | (a-4) | | | | 0.4 | | |
| | Perfume C | 1 | 1 | 1 | 1 | 1 | 1 |
| | (c-1) | 8 | 8 | 8 | 8 | | 8 |
| | (c-2) | | | | | 8 | |
| | Ion exchange water | Balance | Balance | Balance | Balance | Balance | Balance |
| | Total | 100 | 100 | 100 | 100 | 100 | 100 |
| | pH* | 3.5 | 3.5 | 3.5 | 3.5 | 3.6 | 3.5 |
| Longevity of perfume | Wet score | 7.5 | 7.0 | 7.0 | 7.0 | 7.1 | 6.0 |
| | after drying, 1 day later | 6.0 | 5.5 | 5.0 | 5.0 | 5.1 | 4.0 |
| | after drying, 3 days later | 5.0 | 4.5 | 4.0 | 4.0 | 4.1 | 2.0 |
| | Softness | ○ | ○ | ○ | ○ | ○ | ○ |

*pH at 20° C., adjusted using an aqueous 1/10 normal hydrochloric acid solution.

As is apparent from Table 2, it has been confirmed that the product of the present invention exudes a fragrance gradually.

Example 2

Softening treatment was carried out, using each fiber product treating agent shown in Table 3, in the same manner as in Example 1. After drying the fiber product, the longevity of perfume was evaluated 3 days later. The results are shown in Table 3.

As is apparent from Table 3, it has been confirmed that the product of the present invention exudes a fragrance gradually. It has been also confirmed that the product of the present invention exudes a more excellent fragrance of a perfume when the boiling point of the perfume is 250° C. or more and as the ratio of perfumery components having a logPow of 3 or more is increased.

Example 3

Softening treatment was carried out using each fiber product treating agent shown in Table 4 in the same manner as in Example 1 and the Dry-after-three-day longevity of perfume was evaluated. The results are shown in Table 4.

TABLE 3

| | | Products of the invention | | | Comparative product | | |
|---|---|---|---|---|---|---|---|
| | | 6 | 7 | 8 | 2 | 3 | 4 |
| Fiber product treating agent (mass-%) | (a-1) | 0.4 | 0.4 | 0.4 | | | |
| | Perfume B | 1 | | | 1 | | |
| | Perfume C | | 1 | | | 1 | |
| | Perfume D | | | 1 | | | 1 |
| | (c-1) | 8 | 8 | 8 | 8 | 8 | 8 |
| | Ion exchange water | Balance | Balance | Balance | Balance | Balance | Balance |
| | Total | 100 | 100 | 100 | 100 | 100 | 100 |
| pH* | | 3.5 | 3.5 | 3.5 | 3.5 | 3.5 | 3.5 |
| the score of longevity of perfume (after drying, 3 days later) | | 4.0 | 5.0 | 6.0 | 1.5 | 2.0 | 2.5 |

*pH at 20° C., adjusted using an aqueous 1/10 normal hydrochloric acid solution.

TABLE 4

| | | Product of the invention | | | Comparative product | | | | |
|---|---|---|---|---|---|---|---|---|---|
| | | 9 | 10 | 11 | 5 | 6 | 7 | 8 | 9 |
| Fiber product treating agent (mass-%) | (a-5) | 0.4 | 0.4 | 0.4 | | | | | 0.4 |
| | Perfume A | | | | 1 | | | | 1 |
| | Perfume B | 1 | | | | 1 | | | |
| | Perfume C | | 1 | | | | 1 | | |
| | Perfume D | | | 1 | | | | 1 | |
| | (c-1) | 8 | 8 | 8 | 8 | 8 | 8 | 8 | 8 |
| | Ion exchange water | Balance | Balance | Balance | Balance | Balance | Balance | Balance | Balance |
| | Total | 100 | 100 | 100 | 100 | 100 | 100 | 100 | 100 |
| pH* | | 3.5 | 3.5 | 3.5 | 3.5 | 3.5 | 3.5 | 3.5 | 3.5 |
| the score of longevity of perfume (after drying, 3 days later) | | 3.5 | 5.0 | 5.0 | 1.0 | 1.5 | 2.0 | 2.5 | 1.5 |

*pH at 20° C., adjusted using an aqueous 1/10 normal hydrochloric acid solution.

As is apparent from Table 4, the products containing perfumes B, C and D, respectively, and containing perfumery components having a boiling point of 250° C. or more and a logPow of 3 or more in an amount of 20% by weight or more in the component (b) according to the present invention have been found to have an improved longevity of perfume even if the compound (a-5) in which $R^{11}$ has 21 or more carbon atoms is less than 50% by weight as the component (a).

The invention claimed is:

1. A fiber product treating agent comprising (a) at least one compound selected from the group consisting of compounds represented by the following formulae (1-1) and (1-2) and (b) a perfume, wherein a content of perfumery components having a boiling point of 250° C. or more and a logPow of 3 or more is 20% by weight or more in the component (b):

(1-1)

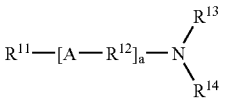

(1-2)

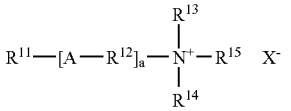

wherein $R^{11}$ represents an alkyl or alkenyl group having 15 to 23 carbon atoms, A represents —CONH— or —NHCO—, $R^{12}$ represents an alkylene group having 1 to 6 carbon atoms, $R^{13}$ and $R^{14}$ respectively represent a hydrogen atom or an alkyl or hydroxyalkyl group having 1 to 3 carbon atoms, $R^{15}$ represents a hydrogen atom or an alkyl or hydroxyalkyl group having 1 to 3 carbon atoms, a denotes a number of 0 or 1 and $X^-$ represents an anionic group.

2. The fiber product treating agent according to claim 1, further comprising at least one compound (hereinafter referred to as a component (c)) selected from the group consisting of compounds represented by the following formulae (2-1) to (2-3):

(2-1)

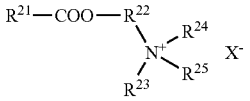

(2-2)

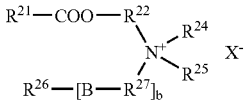

(2-3)

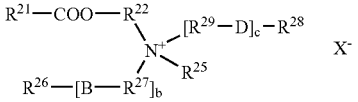

wherein $R^{21}$, $R^{26}$ and $R^{28}$ respectively represent an alkyl or alkenyl group having 15 to 20 carbon atoms, $R^{22}$, $R^{27}$ and $R^{29}$ respectively represent an alkylene group having 1 to 6 carbon atoms, $R^{23}$ and $R^{24}$ respectively represent an alkyl or hydroxyalkyl group having 1 to 3 carbon atoms, $R^{25}$ represents a hydrogen atom or an alkyl or hydroxyalkyl group having 1 to 3 carbon atoms, B and D respectively represent a group selected from the group consisting of —COO—, —OCO—, —CONH— and —NHCO—, b and c respectively denote a number of 0 or 1 and $X^-$ represents an anionic group.

3. The fiber product treating agent according to claim 1, wherein the compounding ratio (component (a)/component (b)) by weight of the component (a) to the component (b) is 1/50 to 1000/1.

4. The fiber product treating agent according to claim 1, wherein a content of compounds as component (a) in which the carbon number of $R^1$ is 21 or more is 50% by weight or more.

5. The fiber product treating agent according to claim 1, wherein a content of compounds as component (a) in which the carbon number of $R^{11}$ is 21 or more is 80% by weight or more.

6. The fiber product treating agent according to claim 1, wherein the content of perfumery components having a boiling point of 250° C. or more and a logPow of 3 or more is 40% by weight or more in the component (b).

7. A method of treating a fiber product comprising applying thereto the fiber product treating agent according to claim 1.

8. A method of increasing the longevity of perfume contained in a fiber product treating agent comprising adding to said agent at least one compound selected from the group consisting of the compounds represented by the following formulae (1-2) and (1-2):

(1-1)

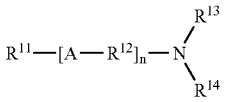

(1-2)

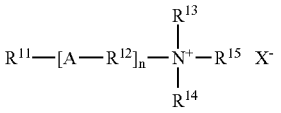

wherein $R^{11}$ represents an alkyl or alkenyl group having 15 to 23 carbon atoms, A represents —CONH— or —NHCO—, $R^{12}$ represents an alkylene group having 1 to 6 carbon atoms, $R^{13}$ and $R^{14}$ respectively represent a hydrogen atom or an alkyl or hydroxyalkyl group having 1 to 3 carbon atoms, $R^{15}$ represents a hydrogen atom or an alkyl or hydroxyalkyl group having 1 to 3 carbon atoms, a denotes a number of 0 or 1 and $X^-$represents an anionic group; and wherein in said perfume a content of perfumery components having a boiling point of 250° C. or more and a logPow of 3 or more is 20% by weight or more.

* * * * *